US011610528B2

(12) United States Patent
Kim et al.

(10) Patent No.: US 11,610,528 B2
(45) Date of Patent: Mar. 21, 2023

(54) OPTICAL COMPENSATION DEVICE, DISPLAY DEVICE, AND OPTICAL COMPENSATION METHOD OF DISPLAY DEVICE

(71) Applicant: SAMSUNG DISPLAY CO., LTD., Yongin-si (KR)

(72) Inventors: Hyung Jin Kim, Yongin-si (KR); Ji Eun Park, Yongin-si (KR); Hyun Seuk Yoo, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/405,540

(22) Filed: Aug. 18, 2021

(65) Prior Publication Data

US 2022/0198977 A1 Jun. 23, 2022

(30) Foreign Application Priority Data

Dec. 17, 2020 (KR) ..... 10-2020-0177880

(51) Int. Cl.
*G09G 3/20* (2006.01)

(52) U.S. Cl.
CPC ..... *G09G 3/20* (2013.01); *G09G 2320/045* (2013.01); *G09G 2320/0673* (2013.01); *G09G 2360/16* (2013.01)

(58) Field of Classification Search
CPC ..... G09G 2320/045; G09G 2320/0673; G09G 2360/16; G09G 3/20
See application file for complete search history.

(56) References Cited

U.S. PATENT DOCUMENTS

| | | | | |
|---|---|---|---|---|
| 8,797,346 | B2 | 8/2014 | Park et al. | |
| 9,159,258 | B2 | 10/2015 | Lee | |
| 10,733,932 | B2 | 8/2020 | Pyo et al. | |
| 2013/0120659 | A1* | 5/2013 | Park | H04N 5/202 348/E5.074 |

FOREIGN PATENT DOCUMENTS

| | | | |
|---|---|---|---|
| KR | 101964427 | B1 | 4/2019 |
| KR | 1020190123828 | A | 11/2019 |
| KR | 102090706 | B1 | 3/2020 |

* cited by examiner

*Primary Examiner* — Gerald Johnson
(74) *Attorney, Agent, or Firm* — Cantor Colburn LLP

(57) ABSTRACT

An optical compensation device includes a luminance measurer that measures display luminance of a display device including a plurality of areas. A gamma corrector corrects a gamma voltage so that a first area of the plurality of areas has a gamma characteristic corresponding to a target gamma value based on the display luminance, and calculates a gamma value for each of the plurality of areas based on the display luminance. An optical compensator calculates a compensation parameter for each grayscale based on the display luminance and the gamma value. A luminance deviation for each of plurality of areas of the display device is compensated based on the compensation parameter.

18 Claims, 13 Drawing Sheets

FIG. 4

LUT

| REFERENCE GRAYSCALE | TARGET LUMINANCE | GAMMA VOLTAGE |
|---|---|---|
| 0 | 0 | 0 |
| 31 | 9.00 | V31 |
| ⋮ | ⋮ | ⋮ |
| 255 | 600 | V255 |

FIG. 6

DATA_ML

| | | | | |
|---|---|---|---|---|
| L_P11 | L_P12 | ... | | |
| L_P21 | ⋱ | | | |
| ⋮ | | | | |
| | | | | |
| | | | | |

FIG. 7

DATA_C_RG1

| | | | | |
|---|---|---|---|---|
| C11_1 (CV11_1) | C12_1 (CV12_1) | ... | | |
| C22_1 (CV22_1) | ⋱ | | | |
| ⋮ | | | | |
| | | | | |
| | | | | |

OPTICAL COMPENSATION DEVICE, DISPLAY DEVICE, AND OPTICAL COMPENSATION METHOD OF DISPLAY DEVICE

This application claims priority to Korean Patent Application No. 10-2020-0177880, filed on Dec. 17, 2020, and all the benefits accruing therefrom under 35 U.S.C. § 119, the content of which in its entirety is herein incorporated by reference.

BACKGROUND

(a) Field

Embodiments of the invention relate to an optical compensation device, a display device, and an optical compensation method of the display device that may compensate a luminance deviation of the display device.

(b) Description of the Related Art

As an interest in an information display largely increases and a demand for using a portable information medium increases, research and commercialization for a display device are progressed in priority.

SUMMARY

A display device may include pixels, and each of the pixels may include a light emitting element and a transistor driving the light emitting element. A deviation occurs in luminance of pixels due to a low temperature polycrystalline silicon process, a deposition process, and the like.

Therefore, during a manufacturing process of the display device, as a process of measuring luminance of the display device (or an image displayed through the display device) and a process of adjusting a voltage applied to the display device (or, a process of adjusting an offset or compensation value for emission characteristics of each of the pixels) are repeated several times, the luminance deviation may be compensated. As such, the process of compensating for the luminance deviation is referred to as optical compensation.

For more accurate optical compensation for the display device, a process of measuring luminance for and a process of setting an offset for more reference grayscales (i.e., some grayscales used for optical compensation) should be repeated. As the number of reference grayscales increases, a total time desired for luminance measurement increases, and a tact time increases. In addition, as the number of reference grayscales increases, the number of offsets for an emission characteristic of each pixel increases, and memories for storing the offsets increases.

One feature of the invention is to provide an optical compensation device and an optical compensation method that may more accurately compensate for a luminance deviation while reducing an optical compensation time (i.e., tact time).

Another feature of the invention is to provide a display device that may reduce capacity of an offset (or compensation parameter) for optical compensation.

It is obvious that the feature of the invention is not limited to the above-described feature, and may be variously extended without departing from the spirit and scope of the invention.

An embodiment of the invention provides an optical compensation device for a display device including a plurality of areas. The optical compensation device includes a luminance measurer measuring display luminance of the display device, a gamma corrector that corrects a gamma voltage so that a first area of the plurality of areas has a gamma characteristic corresponding to a target gamma value based on the display luminance, and calculates a gamma value for each of the plurality of areas based on the display luminance, and an optical compensator calculating a compensation parameter for each of grayscales based on the display luminance and the gamma value. A luminance deviation for each of the plurality of areas of the display device is compensated based on the compensation parameter.

In an embodiment, the gamma corrector may calculate the gamma value based on display luminances measured corresponding to a plurality of reference grayscales in a process of correcting the gamma voltage.

In an embodiment, at least two areas of the plurality of areas may have different gamma values from each other.

In an embodiment, the display device may further include a pixel, and a first compensation parameter for a first grayscale may be defined as a ratio of a first target luminance to a first display luminance of the pixel corresponding to the first grayscale.

In an embodiment, the optical compensator may calculate a second target luminance of the pixel for a second grayscale based on the first target luminance and the target gamma value, may predict a second display luminance of the pixel corresponding to the second grayscale based on the first display luminance and the gamma value, and may calculate a second compensation parameter for the second grayscale based on the second target luminance and the second display luminance.

In an embodiment, the optical compensator calculates the compensation parameter based on an equation below, $$C_i = \frac{L_{Ti}}{L_{Pi}} = \frac{L_{T1} \cdot (Gi/G1)^{\gamma T}}{L_{P1} \cdot (Gi/G1)^{\gamma P}} \quad \text{[Equation]}$$

where Ci denotes a compensation parameter for an i-th grayscale where i is a positive integer, $L_{Ti}$ denotes a target luminance for an i-th reference grayscale, $L_{T1}$ denotes a target luminance for a first reference grayscale, Gi denotes a value of the i-th reference grayscale, G1 denotes a value of the first reference grayscale, γT denotes a target gamma value, $L_{Pi}$ denotes a predicted luminance of a corresponding pixel for the i-th reference grayscale, $L_{P1}$ denotes a measured luminance of the corresponding pixel for the first reference grayscale, and γP denotes a gamma value of an area including a corresponding pixel.

In an embodiment, the optical compensator may generate first compensation data including the first compensation parameter and second compensation data including the second compensation parameter, respectively.

In an embodiment, the optical compensator may calculate a compensation value for the first grayscale based on the first display luminance and the first compensation parameter, and the compensation value may correspond to a grayscale that causes the pixel to emit light with the first target luminance.

In an embodiment, after the gamma voltage is corrected by the gamma corrector, in a process of generating the compensation parameter, the luminance measurer may measure the display luminance for only one reference grayscale of the plurality of reference grayscales.

Another embodiment of the invention provides a display device including a display panel including pixels, a storage which stores compensation data including a compensation parameter set for at least a pixel of the pixels, a data compensator which generates compensated data by compensating image data based on the compensation data, and a data driver that generates data voltages based on the compensated data and provides the data voltages to the pixels. The data compensator may calculate display luminance for each of grayscales of the pixels based on the compensation parameter, may calculate a compensation value based on a difference between the display luminance and a target luminance for each of the grayscales, and may compensate a data value included in the image data based on the compensation value.

In an embodiment, the compensation data may further include a gamma value for the at least the pixel of the pixels.

Another embodiment of the invention provides an optical compensation method that is performed for a display device including a plurality of areas. The optical compensation method includes while measuring display luminance of the display device, correcting a gamma voltage based on the display luminance so that a first area of the plurality of areas has a gamma characteristic corresponding to a target gamma value, calculating a gamma value for each of the plurality of areas based on the display luminance, and calculating a compensation parameter for each of grayscales based on the display luminance and the gamma value.

In an embodiment, a luminance deviation for each of the plurality of areas of the display device may be compensated based on the compensation parameter.

In an embodiment, the correcting the gamma voltage may include providing a first data voltage corresponding to a first reference grayscale to the display device, and measuring a first display luminance of the display device displaying an image corresponding to the first data voltage, determining whether a difference between a first target luminance for the first reference grayscale and the first display luminance is within a reference range, and determining the first data voltage as an updated gamma voltage when the difference between the first target luminance and the first display luminance is within a reference range.

In an embodiment, the calculating the compensation parameter may include measuring a first display luminance of the display device for a first grayscale, calculating a first compensation parameter for the first grayscale based on the first display luminance, and calculating a second compensation parameter for a second grayscale different from the first grayscale based on the first display luminance and the gamma value.

In an embodiment, the first compensation parameter may be defined as a ratio of the first target luminance for the first grayscale to the first display luminance.

In an embodiment, the calculating the second compensation parameter may include calculating a second target luminance of a pixel for a second grayscale based on the first target luminance and the target gamma value, predicting a second display luminance of the pixel corresponding to the second grayscale based on the first display luminance and the gamma value, and calculating the second compensation parameter based on the second target luminance and the second display luminance.

In an embodiment, in the calculating the second compensation parameter, the compensation parameter may be calculated based on a following equation, $$C_i = \frac{L_{Ti}}{L_{Pi}} = \frac{L_{T1} \cdot (Gi/G1)^{\gamma T}}{L_{P1} \cdot (Gi/G1)^{\gamma P}} \quad \text{[Equation]}$$

where Ci denotes a compensation parameter for an i-th grayscale where i is a positive integer, $L_{Ti}$ denotes a target luminance for an i-th reference grayscale, $L_{T1}$ denotes a target luminance for a first reference grayscale, Gi denotes a value of the i-th reference grayscale, G1 denotes a value of the first reference grayscale, γT denotes a target gamma value, $L_{Pi}$ denotes a predicted luminance of a corresponding pixel for the i-th reference grayscale, $L_{P1}$ denotes a measured luminance of the corresponding pixel for the first reference grayscale, and γP denotes a gamma value of an area including a corresponding pixel.

In an embodiment, the calculating the first compensation parameter may include calculating a compensation value for the first grayscale based on the first display luminance and the first compensation parameter, and the compensation value corresponds to a grayscale that causes the pixel to emit light with the first target luminance.

In an embodiment, the calculating the compensation parameter may include measuring only the first display luminance of the display device for the first grayscale once.

According to the optical compensation device and the optical compensation method of the embodiments of the invention, it is possible to calculate a gamma value for each area of the display device based on luminances measured in a gamma correction process, it is possible to measure only luminance for one reference gray level in an optical compensation process, it is possible to predict luminance for other reference grayscales based on the measured luminance and a preset gamma value for each area, and it is possible to set a compensation parameter (or compensation value) for another reference grayscale based on the predicted luminance. In the optical compensation process, since luminance is measured for only one reference grayscale, not a plurality of reference grayscales, an optical compensation time (i.e., tact time) may be reduced.

The display device in the embodiments of the invention may calculate a compensation value for a predetermined grayscale of a pixel based on a compensation parameter and a gamma value for a predetermined grayscale. Therefore, compared with a case in which all compensation parameters for each grayscale are included, a capacity of a compensator for storing compensation parameters may be reduced.

However, the effects of the invention are not limited to the above-described effects, and may be variously extended without departing from the spirit and scope of the invention.

BRIEF DESCRIPTION OF THE DRAWINGS

The above and other embodiments, advantages and features of this disclosure will become more apparent by describing in further detail embodiments thereof with reference to the accompanying drawings below.

FIG. 4 illustrates a drawing of target luminances used in the compensator of FIG. 3.

FIG. 6 illustrates an embodiment of luminance data measured by the optical compensation device of FIG. 1.

FIG. 7 illustrates an embodiment of compensation data generated by the compensator of FIG. 3.

DETAILED DESCRIPTION

Figure 1:
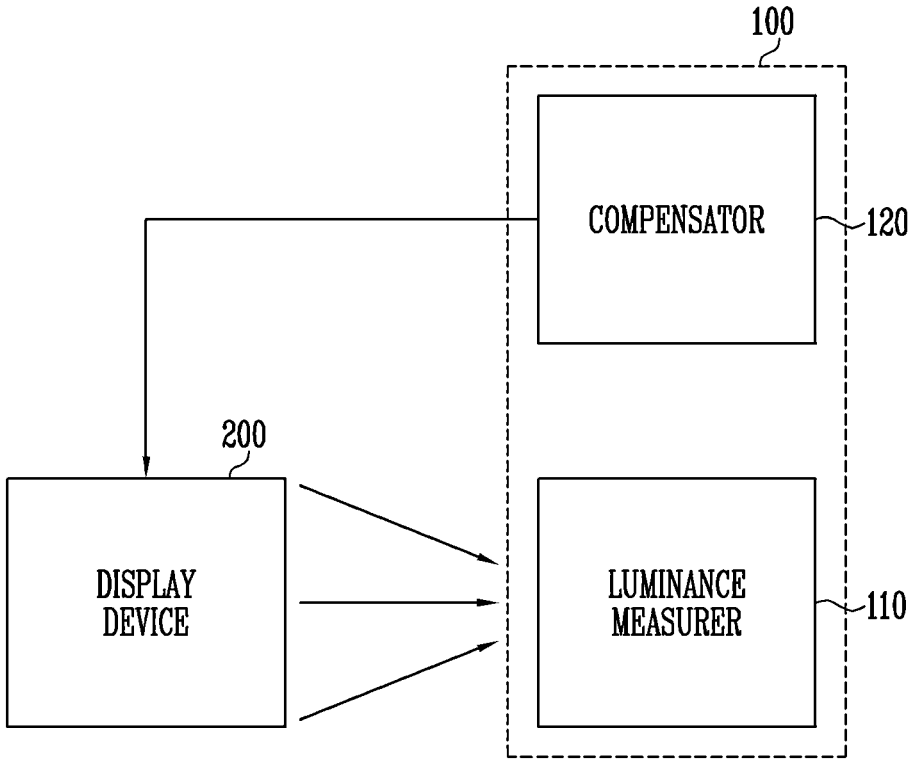
FIG. 1 illustrates a block diagram of an embodiment of an optical compensation device according to the invention.

As is customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the invention. Further, the blocks, units, and/or modules of some embodiments may be physically combined into more complex blocks, units, and/or modules without departing from the scope of the invention.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Embodiments of the invention will be described more fully hereinafter with reference to the accompanying drawings, in which embodiments of the invention are shown. As those skilled in the art would realize, the described embodiment may be modified in various different ways, all without departing from the spirit or scope of the present.

In order to clearly describe the invention, parts that are irrelevant to the description are omitted, and identical or similar constituent elements throughout the specification are denoted by the same reference numerals. Therefore, the above-mentioned reference numerals may be used in other drawings.

Further, in the drawings, the size and thickness of each element are arbitrarily illustrated for ease of description, and the invention is not necessarily limited to those illustrated in the drawings.

Figure 2A:
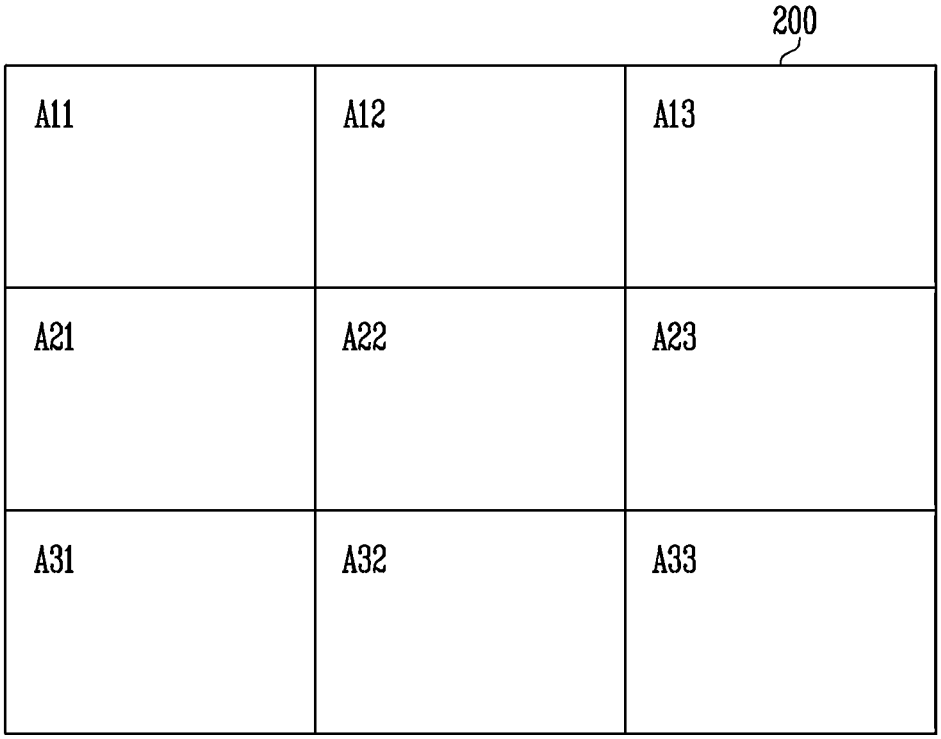
FIG. 2A and FIG. 2B illustrate schematic views of an embodiment of a display device.
Figure 2B:
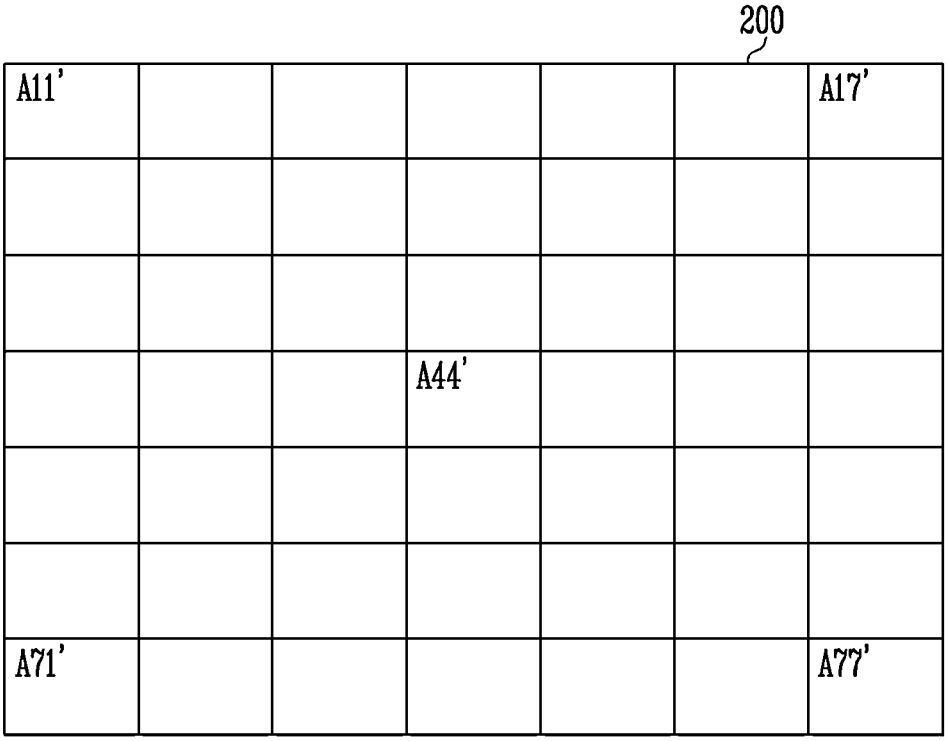

FIG. 1 illustrates a block diagram of an embodiment of an optical compensation device according to the invention. FIG. 2A and FIG. 2B illustrate schematic views of an embodiment of a display device.

Referring to FIG. 1, FIG. 2A, and FIG. 2B, an optical compensation device 100 for a display device (or display panel) 200 may include a luminance measurer (or an image capturer) 110 and a compensator 120.

The luminance measurer 110 may capture an image displayed through the display device 200. In an embodiment, the luminance measurer 110 may include a camera scanner, a photosensor, and the like, for example. The luminance measurer 110 may measure luminance (or display luminance) of the display device 200 (or an image displayed through the display device 200). The luminance measurer 110 may divide the display device 200 into a plurality of areas (or unit areas) to measure luminance of at least one of the areas. Each of the areas may include at least one pixel.

In an embodiment, as shown in FIG. 2A, the luminance measurer 110 divides the display device 200 into areas of 3 rows by 3 columns (A11, A12, A13, A21, A22, A23, A31, A32, A33) to measure luminance of each of these areas, for example. As will be described later, when the optical compensation device 100 performs a gamma correction operation, luminance measured in one of the areas (A11, A12, A13, A21, A22, A23, A31, A32, A33), for example, in a twenty-second area A22 disposed at a center of the display device 200 may be used.

In another embodiment, as shown in FIG. 2B, the luminance measurer 110 divides the display device 200 into areas of 7 rows by 7 columns (A11', A17', A44', A71', A77', etc.) to measure luminance of each of these areas. The optical compensation device 100 may perform a gamma correction operation by luminance measured in a forty-fourth area A44' disposed at the center of the display device 200.

When the display device 200 displays an image with luminance corresponding to a predetermined luminance level (or predetermined target luminance), the luminance measurer 110 may generate a captured image for a predetermined luminance level, or may generate luminance information or luminance data for the captured image. Here, the luminance level may be one of a plurality of reference luminance levels (or, representative luminance levels, for example, 11 luminance levels selected from luminance levels corresponding to a total of 256 grayscales) used during a gamma correction process and an optical compensation process of the display device 200. As will be described later, the luminance measurer 110 may respectively generate luminance information or luminance data for reference luminance levels (or reference grayscales) in the gamma correction process, and may generate luminance information or luminance data for only one of the reference luminance levels (or only one reference grayscale) in the optical compensation process. Therefore, an optical compensation time (i.e., tact time) may be reduced.

The compensator 120 may control the operation of the display device 200, and may set or adjust signals desired for the operation of the display device 200 based on the images or luminance information (i.e., measured luminances) obtained through the luminance measurer 110.

Figure 9:
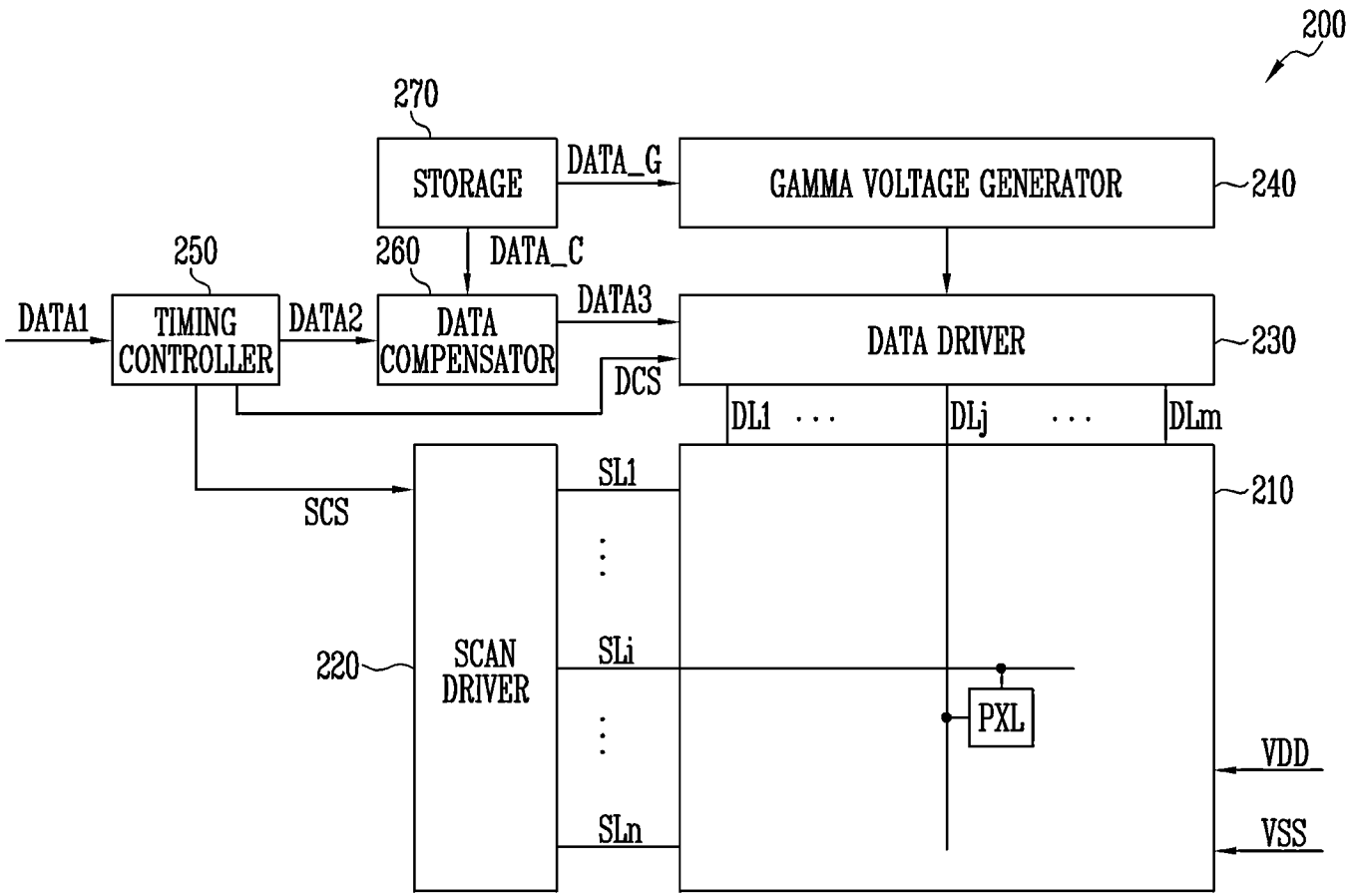
FIG. 9 illustrates a block diagram of an embodiment of a display device according to the invention.

In an embodiment, the compensator 120 may control the display device 200 to display an image corresponding to a predetermined luminance level, for example. In an embodiment, the compensator 120 may provide a data voltage corresponding to the predetermined luminance level to the display device 200, for example. Referring to FIG. 9, as will be described later, the display device 200 may display an image with luminance corresponding to the data voltage.

The compensator 120 may perform gamma correction so that the display device 200 has a gamma characteristic corresponding to a target gamma value. In other words, the compensator 120 may perform a multi-time programming ("MTP") operation that repeatedly corrects the gamma characteristic of the display device 200 in terms of luminance and/or color coordinates.

In an embodiment, the compensator 120 may set or adjust a voltage level of a data voltage for a corresponding luminance level based on a luminance level and luminance measured corresponding to the luminance level (e.g., luminance measured in the twenty-second area A22 of FIG. 2A or the forty-fourth area A44' of FIG. 2B), for example. The compensator 120 may repeatedly adjust the voltage level of the data voltage until a difference between the measured luminance and the luminance level becomes within a reference range. When the difference between the measured luminance and the luminance level is within the reference range, the compensator 120 may determine or store a voltage level of the finally adjusted data voltage as a gamma voltage (or reference gamma voltage). In addition, the compensator 120 may set a plurality of gamma voltages by repeating an operation of adjusting the voltage level of the data voltage for a plurality of reference luminance levels (or reference grayscales). The compensator 120 may generate or convert a gamma lookup table including predetermined gamma voltages, and may record or update the gamma lookup table in the display device 200 (e.g., a memory device or driving integrated circuit ("IC") in the display device 200).

In an embodiment, the compensator 120 may calculate and store a gamma value for each area of the display device 200 based on the luminance values obtained in the gamma correction process. For reference, even when an central area of the display device 200 is set to have a target gamma value (e.g., a gamma value of 2.2), due to a process deviation, at least some of the other areas of the display device 200 may have a different gamma value (e.g., gamma value of 2.1 or 2.3) from the target gamma value. In an embodiment, the compensator 120 may perform the gamma correction so that the gamma value of the twenty-second area A22 has a target value with reference to FIG. 2A, and in this process, the compensator 120 may calculate a gamma value of each of the remaining areas (A11, A12, A13, A21, A23, A31, A32, A33) based on the luminance values obtained for the remaining areas (A11, A12, A13, A21, A23, A31, A32, A33), for example. The gamma value calculated for each area may be used to calculate a compensation parameter for each grayscale to compensate for the luminance deviation in the optical compensation process.

In addition, the compensator 120 may calculate or set the compensation parameter for each grayscale based on the luminance and the gamma value measured for the predetermined luminance level. Here, the compensation parameter may indicate a relationship between a target luminance corresponding to a predetermined luminance level (or a predetermined reference grayscale) and an actual luminance (or display luminance), or may indicate a ratio of the target luminance to the actual luminance. In an embodiment, the compensator 120 may set a first compensation parameter for a first reference grayscale of a corresponding pixel based on luminance measured for a first luminance level (and a target luminance according to the first luminance level), for example. In addition, the compensator 120 may predict luminance (i.e., actual luminance) for a second luminance level based on the luminance measured for the first luminance level and the gamma value, and may set a second compensation parameter for a second reference grayscale based on the predicted luminance for the second luminance level (and a target luminance according to the second luminance level).

As will be described later, since the luminance deviations (or spot characteristics) of the display device 200 are different depending on the luminance levels, the general optical compensation measures luminances for two or more luminance levels, and a compensation value for each of two or more reference grayscales is set based on the measured luminances. In an alternative embodiment, the optical compensation device 100 may measure only luminance for one luminance level, may predict luminance for another luminance level based on the measured luminance and a preset gamma value for each area, and may set a compensation parameter (or a compensation value) based on the predicted luminance. Since the optical compensation device 100 measures only luminance for one luminance level, the optical compensation time (i.e., tact time) may be reduced. In addition, since the gamma value is calculated based on the luminances measured for a plurality of luminance levels (e.g., 11 luminance levels) in the gamma correction process, the luminance for another luminance level may be accurately predicted based on the gamma value, and the accuracy of the compensation parameter may be improved.

The compensator 120 may generate or convert compensation data (or compensation lookup table) including the compensation parameter (or compensation value corresponding thereto) set for each grayscales, and may write or update the compensation data in the display device 200 (e.g., a memory device or a driving IC in the display device 200).

As described above, the optical compensation device 100 may calculate the gamma value for each area of the display device 200 based on the luminances measured in the gamma correction process, may measure only the luminance for one luminance level in the optical compensation process, may predict the luminance for another luminance level based on the measured luminance and the preset gamma value for each area, and may set the compensation parameter (or compensation value) for another luminance level based on the predicted luminance. Therefore, an optical compensation time (i.e., tact time) may be reduced.

Figure 3:
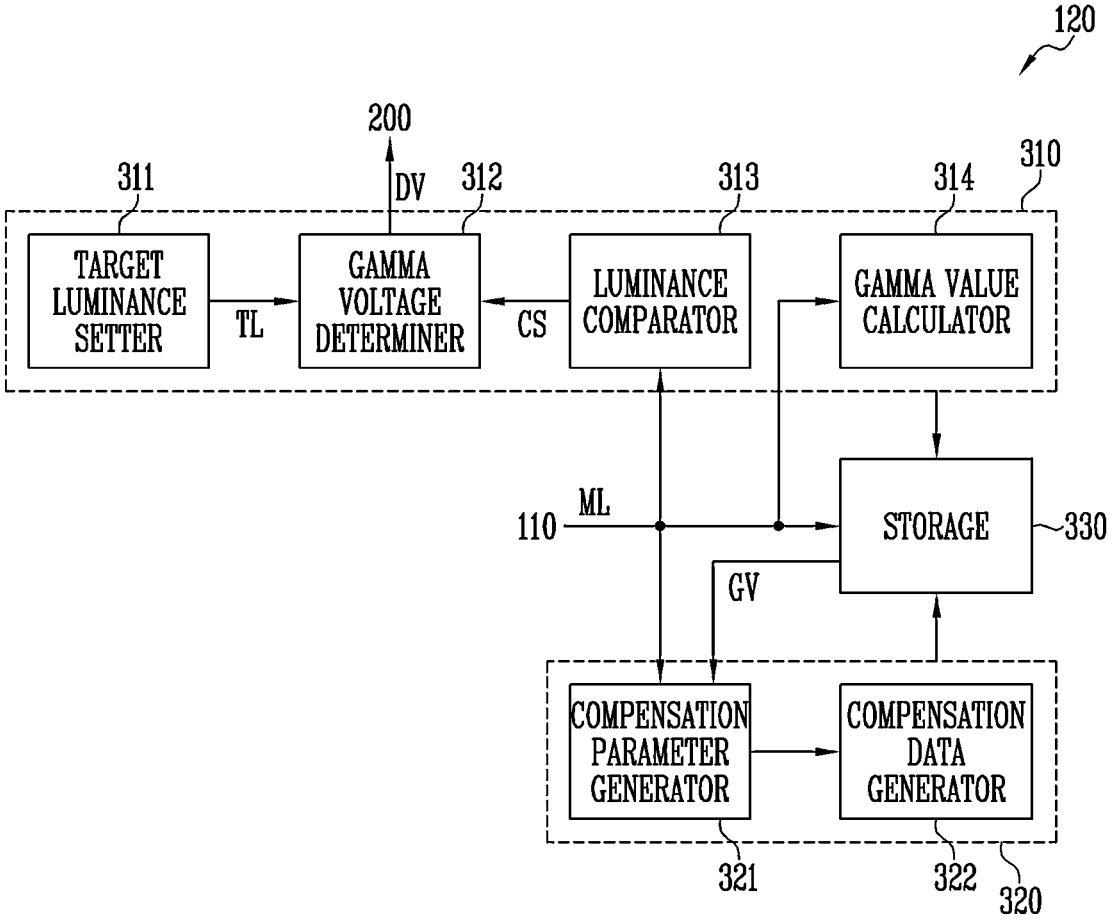
FIG. 3 illustrates a block diagram of an embodiment of a compensator included in the optical compensation device of FIG. 1.
Figure 5:
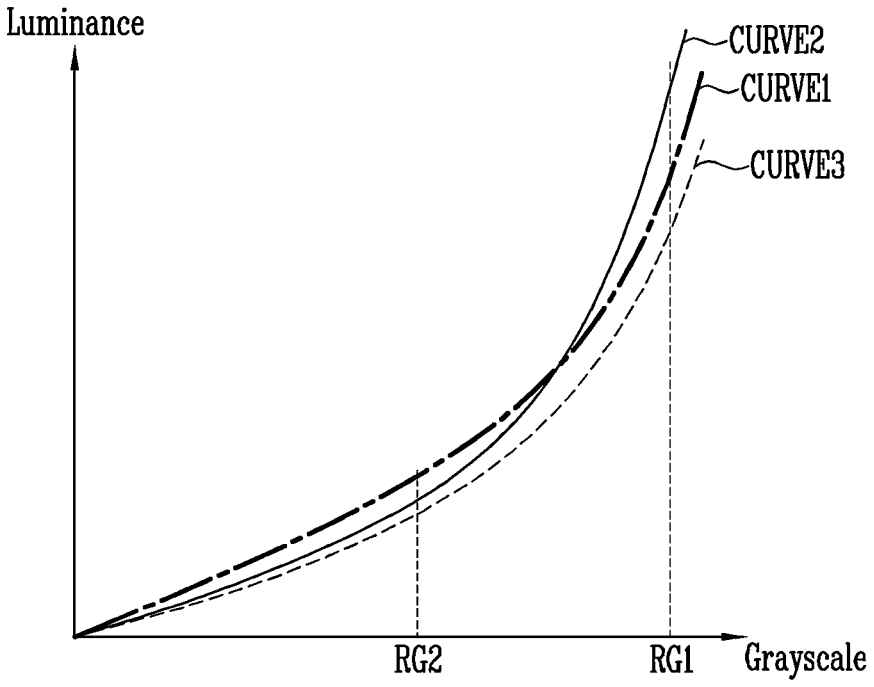
FIG. 5 illustrates an embodiment of a gamma curve for each area of a display device.

FIG. 3 illustrates a block diagram of an embodiment of a compensator included in the optical compensation device of FIG. 1. FIG. 4 illustrates a drawing of target luminance used in the compensator of FIG. 3. FIG. 5 illustrates an embodiment of a gamma curve for each area of a display device. FIG. 6 illustrates an embodiment of luminance data measured by the optical compensation device of FIG. 1. FIG. 7 illustrates an embodiment of compensation data generated by the compensator of FIG. 3.

Referring to FIG. 3 to FIG. 7, the compensator 120 may include a gamma corrector (or a gamma correction block) 310, an optical compensator (an optical compensation block) 320, and a storage 330.

The gamma corrector 310 may perform a gamma correction operation on the display device 200 and may calculate a gamma value for each area.

The gamma corrector 310 may include a target luminance setter (or a target luminance setting block) 311, a gamma voltage determiner (or a gamma voltage determination block) 312, a luminance comparator (or a luminance comparison block) 313, and a gamma value calculator (or a gamma value calculation block) 314.

The target luminance setter (or luminance level selector) may set a target luminance (or luminance level) TL for performing a gamma correction operation among a plurality of luminance levels.

Referring to FIG. 4, for example, the lookup table LUT may include reference grayscales and information on target luminances corresponding thereto. The lookup table LUT may be previously stored in the storage 330. The reference grayscales correspond to some selected grayscales among a plurality of grayscales, and for example, the reference grayscales may correspond to an inflection point in a gamma curve (i.e., a curved line indicating a relationship between grayscale-luminance, refer to FIG. 5). In an embodiment, the reference grayscales may include a grayscale of 0, a grayscale of 31, and a grayscale of 255 among 256 grayscales, for example. The target luminances may be preset according to a desired specification of the display device 200 (e.g., the maximum luminance and target gamma value). In an embodiment, a target luminance (or first luminance level) corresponding to a grayscale of 255 (or, first reference grayscale) may be 600 nits, and a target luminance (or second luminance level) corresponding to a grayscale of 31 (or second reference grayscale) may be 9 nits, for example.

In an embodiment, the target luminance setter 311 may select the target luminance of 600 nits corresponding to the grayscale of 255 from the lookup table LUT in order to set a gamma voltage (or data voltage) for the grayscale of 255, for example. After the gamma voltage for the grayscale of 255 is set, the target luminance setter 311 may select the target luminance of 9 nits corresponding to the grayscale of 31 from the lookup table LUT in order to set a gamma voltage (or data voltage) for the grayscale of 31.

The gamma voltage determiner 312 may generate a data voltage DV corresponding to the selected target luminance TL. The data voltage DV may be provided to the display device 200. Referring to FIG. 4, for example, when the target luminance TL is 600 nits, the gamma voltage determiner 312 may determine a 255th voltage value V255 as the data voltage DV and generate the corresponding data voltage DV.

The luminance comparator 313 may compare luminance ML measured by the luminance measurer 110 and the target luminance TL to determine whether a difference in luminance between the measured luminance ML and the target luminance TL is within a reference range and to generate a control signal CS for adjusting a voltage level of the data voltage DV based on the determined result. The luminance comparator 313 may use the luminance ML measured in a predetermined area of the display device 200, and for example, the luminance comparator 313 may use the luminance measured in a 22nd area A22 of FIG. 2A or a 44th area A44' of FIG. 2B.

In an embodiment, when the measured luminance ML is higher than the target luminance TL, the control signal CS that increases (or decreases) the voltage level of the data voltage may be generated, for example. In another embodiment, when the measured luminance ML is lower than the target luminance TL, the control signal CS that decreases (or increases) the voltage level of the data voltage may be generated.

In this case, the gamma voltage determiner 312 may adjust the data voltage DV based on the control signal CS of the luminance comparator 313. When the target luminance TL is 600 nits, the gamma voltage determiner 312 may adjust the data voltage DV to have a voltage value corresponding to a grayscale lower (or higher) than the 255th voltage value V255 according to the control signal CS.

In addition, the luminance comparator 313 may generate the control signal CS that determines the data voltage DV as a gamma voltage when the difference in luminance between the measured luminance ML and the target luminance TL is within a reference range. In this case, the gamma voltage determiner 312 may determine the data voltage DV as the gamma voltage based on the control signal CS of the luminance comparator 313. In an embodiment, the gamma voltage determiner 312 determines the voltage value reflecting the correction voltage value derived in the gamma correction process to the 255th voltage value V255 as the gamma voltage corresponding to the target luminance of 600 nits (or a reference grayscale of 255), for example. The determined gamma voltage may be included in a separate gamma lookup table, and may be stored in the storage 330.

When the gamma voltage corresponding to the first reference grayscale (e.g., reference grayscale of 255) is completely set, in the same method as the method of setting the gamma voltage corresponding to the first reference grayscale, gamma voltages corresponding to other reference grayscales (e.g., a reference grayscale of 31) may be set.

The gamma value calculator 314 may calculate a gamma value based on luminances measured in the gamma correction process.

Referring to FIG. 2A and FIG. 5, for example, a first curved line CURVE1 indicates the luminance (or, luminance characteristics and gamma characteristics according to grayscales) measured in the 22nd area A22, a second curved line CURVE2 indicates the luminance measured in the 11th area A11, and a third curved line CURVE3 may indicate the luminance measured in the 33rd area A33.

When gamma correction is performed so that the 22nd area A22 has a target gamma value (e.g., a gamma value of 2.2), the first curved line CURVE1 may have the target gamma value.

By the process deviation, the luminance measured in the 11th area A11 and the luminance measured in the 33rd area A33 may be different from the luminance measured in the 22nd area A22. Particularly, a rate of change of luminance according to the grayscale may differently appear in the first curved line CURVE1, the second curved line CURVE2, and the third curved line CURVE3. In an embodiment, the luminance according to the second curved line CURVE2 for a first reference grayscale RG1 may be higher than the luminance according to the first curved line CURVE1, but the luminance according to the second curved line CURVE2 for a second reference grayscale RG2 may be lower than the luminance according to the first curved line CURVE1, for example. That is, the gamma value of the second curved line CURVE2 may be different from that of the first curved line CURVE1.

The gamma value calculator 314 may calculate the gamma value for the 11th area A11 based on the second curved line CURVE2. In an embodiment, the gamma value calculator 314 may calculate the gamma value of the corresponding area by substituting the measured luminances for the reference grayscales into a predetermined equation (e.g., "luminance=a×(grayscale)^(gamma value)") where a is a constant, for example. In some embodiments, the gamma value calculator 314 may configure a target gamma value (e.g., target gamma value in the optical compensation process) of a corresponding area and a calculated gamma value as a pair to determine it as the gamma value for the corresponding area.

In this way, the gamma value calculator 314 may calculate the gamma value for each of the entire areas of the display device 200 (e.g., the areas A11, A12, A13, A21, A22, A23, A31, A32, and A33 in FIG. 2A). At least some of the entire areas of the display device 200 may have different gamma values, but is not limited thereto. The gamma value for each area may be stored in the storage 330.

The optical compensator 320 may perform optical compensation for the display device 200.

The optical compensator 320 may include a compensation parameter generator 321. In some embodiments, the optical compensator 320 may further include a compensation data generator 322.

The compensation parameter generator 321 may calculate or set a compensation parameter for each grayscale of a corresponding pixel based on the luminance and gamma value of a pixel measured for a predetermined luminance level (or a predetermined reference grayscale).

First, the compensation parameter generator 321 may define a compensation parameter as represented in Equation 1 below.

$$L_T = C \cdot L_P \quad \text{(Equation 1)}$$

Here, $L_T$ denotes a target luminance, and $L_P$ denotes a measured luminance of a corresponding pixel, and C denotes a compensation parameter (or compensation coefficient).

That is, the compensation parameter represents the relationship between the target luminance corresponding to a predetermined reference grayscale and the measured luminance (or, the actual luminance before the optical compensation), and it may be defined as a ratio of the target luminance to the measured luminance, that is, the compensation ratio to make the measured luminance equal to the target luminance.

In an embodiment, the compensation parameter generator 321 may calculate a compensation parameter for each grayscale of a pixel based on the luminance ML and gamma value GV measured for a predetermined reference grayscale (hereinafter, also referred to as a "first reference grayscale"). In an embodiment, the first reference grayscale may correspond to a grayscale of 255, the largest of 256 grayscales, for example, but is not limited thereto. The luminance ML measured for the first reference grayscale may be provided from the luminance measurer 110. Referring to FIG. 6, for example, the luminance measurer 110 may generate luminance data DATA_ML including luminance values (L_P11, L_P12, L_P21, etc.) measured for each pixel for the first reference grayscale. In order to calculate luminance values in pixel units, the luminance measurer 110 used in the optical compensation process may have higher performance (e.g., high resolution) than the luminance measurer 110 used in the gamma correction process, but is not limited thereto. In an embodiment, one luminance measurer 110 may be used in a gamma compensation process and a gamma correction process, for example. Since adjacent pixels have similar light emitting characteristics (or gamma characteristics), compensation parameters are calculated by selecting only some pixels for each area according to the performance of the luminance measurer 110, and compensation parameters for the remaining pixels may be calculated by interpolating the compensation parameters calculated for the some pixels according to positions.

Hereinafter, a process of calculating a compensation parameter for an 11th pixel will be described. It is assumed that the 11th pixel has a gamma characteristic corresponding to the second curved line CURVE2 described above with reference to FIG. 5.

First, since the target luminance for the first reference grayscale and the measured luminance have been obtained, the compensation parameter generator 321 may calculate the compensation parameter for the first reference grayscale by Equation 1. In an embodiment, when the target luminance for the grayscale of 255, which is the first reference grayscale RG1, is 600 nits, and the measurement luminance for the grayscale of 255, which is the first reference grayscale RG1, is 660 nits, the compensation parameter for the first reference grayscale RG1 is about 0.91, for example.

The compensation parameter generator 321 may calculate a compensation parameter for the remaining reference grayscales (or grayscales) excluding the first reference grayscale based on Equation 2 and Equation 3 below.

$$L_{Ti} = L_{T1} \cdot (Gi/G1)^{\gamma T}$$

$$L_{Pi} = L_{P1} \cdot (Gi/G1)^{\gamma P} \quad \text{(Equation 2)}$$

Here, $L_{Ti}$ denotes a target luminance for an i-th reference grayscale, $L_{T1}$ denotes a target luminance for the first reference grayscale, Gi denotes a value of the i-th reference grayscale, G1 denotes a value of the first reference grayscale, and $\gamma_T$ denotes a target gamma value. In addition, $L_{Pi}$ denotes a predicted luminance of a pixel for the i-th reference grayscale, $L_{P1}$ denotes a measured luminance of the pixel for the first reference grayscale, and $\gamma_P$ denotes a gamma value of a corresponding pixel (or an area including the corresponding pixel).

$$C_i = \frac{L_{Ti}}{L_{Pi}} = \frac{L_{T1} \cdot (Gi/G1)^{\gamma T}}{L_{P1} \cdot (Gi/G1)^{\gamma P}} \quad \text{[Equation 3]}$$

Here, Ci denotes a compensation parameter for the i-th reference grayscale. Equation 3 is derived by applying Equation 2 to Equation 1.

Referring to FIG. 5, for example, the target luminance for the second reference grayscale RG2 may be derived by Equation 2 (and the first curved line CURVE1 described with reference to FIG. 5), and the predicted luminance for the second reference grayscale RG2 may be derived by Equation 2 (and the second curved line CURVE2 described with reference to FIG. 5). Thereafter, a compensation parameter for the second reference grayscale RG2 may be calculated by applying the target luminance and the predicted luminance for the second reference grayscale RG2 to Equation 3 (or Equation 1).

In an embodiment, when the target luminance for the grayscale of 255, which is the first reference grayscale RG1, is 600 nits, and when the target gamma value is 2.2, the target luminance for the grayscale of 50, which is the second reference grayscale RG2, may be about 16.6 according to Equation 2, for example. When the measured luminance for the grayscale of 225, which is the first reference grayscale RG1, is 660, and when the gamma value (i.e., the gamma value of the 11th area A11 including the 11th pixel) is 2.3, the predicted luminance for the second reference grayscale RG2 may be about 15.5 according to equation 2. In this case, the compensation parameter for the second reference grayscale RG2 may be about 1.07.

In the above-described manner, the compensation parameter generator 321 may calculate a grayscale compensation parameter for each pixel.

The compensation data generator 322 may generate compensation data based on the grayscale compensation parameter of each of the pixels generated by the compensation parameter generator 321. The compensation data generator 322 may generate compensation data for each grayscale. Referring to FIG. 7A, for example, first compensation data DATA_C_RG1 for the first reference grayscale RG1 may include first compensation parameters (C11_1, C12_1, C22_1, etc.) set for each pixel. In an embodiment, similar to the first compensation data DATA_C_RG1, second compensation data for the second reference grayscale RG2 may include second compensation parameters set for each pixel. The compensation data may be stored in the storage 330, for example.

In an embodiment, the compensation data generator 322 may calculate a compensation value based on a corresponding grayscale and compensation parameter, and may generate compensation data including the compensation value. In an embodiment, the compensation data generator 322 may calculate the grayscale of the 11th pixel (i.e., the grayscale to be corrected, for example, the grayscale of 245) by applying the compensation parameter for the first reference grayscale RG1 to Equation 3, and may calculate a compensation value (e.g., a compensation value of −5) for compensating the first reference grayscale RG1 with the calculated grayscale, for example. In the above-described manner, the compensation data generator 322 may calculate a compensation value for each of the pixels. Referring to FIG. 7, for example, the first compensation data DATA_C_RG1 for the first reference grayscale RG1 may include the first compensation values (CV11_1, CV12_1, CV22_1, etc.) set for each pixel, and the second compensation data for the second reference grayscale RG2 may include the second compensation values set for each pixel.

As described above, the compensator 120 may calculate the gamma value for each area of the display device 200 based on the luminances measured in the gamma correction process, may measure only the luminance for one reference grayscale in the optical compensation process, may predict the luminance for another reference grayscale based on the measured luminance and the preset gamma value for each area, and may set the compensation parameter (or compensation value) for another reference grayscale based on the predicted luminance. In the optical compensation process, since luminance is measured for only one reference grayscale, not a plurality of reference grayscales, an optical compensation time (i.e., tact time) may be reduced. In addition, since the gamma value for each area is calculated based on the luminances measured for a plurality of grayscales in the gamma correction process, luminance for another reference grayscale may be accurately predicted based on the gamma value, and a compensation parameter for another reference grayscale may be accurately calculated.

In FIG. 7, it has been described that the compensation data includes the compensation parameter (or compensation values) set for each pixel, but the compensation data is but is not limited thereto. In an embodiment, the compensation data may include a compensation parameter and a gamma value for a predetermined reference grayscale (e.g., the first reference), for example. In another embodiment, the compensation data may include the luminance and gamma value of the pixel measured for a predetermined reference grayscale (e.g., the first reference). In this case, the display device 200 may calculate compensation parameters (or compensation values) for each grayscale of each of the pixels based on the compensation data (i.e., the luminance and gamma value of the pixel measured for a predetermined reference grayscale).

Figure 8:
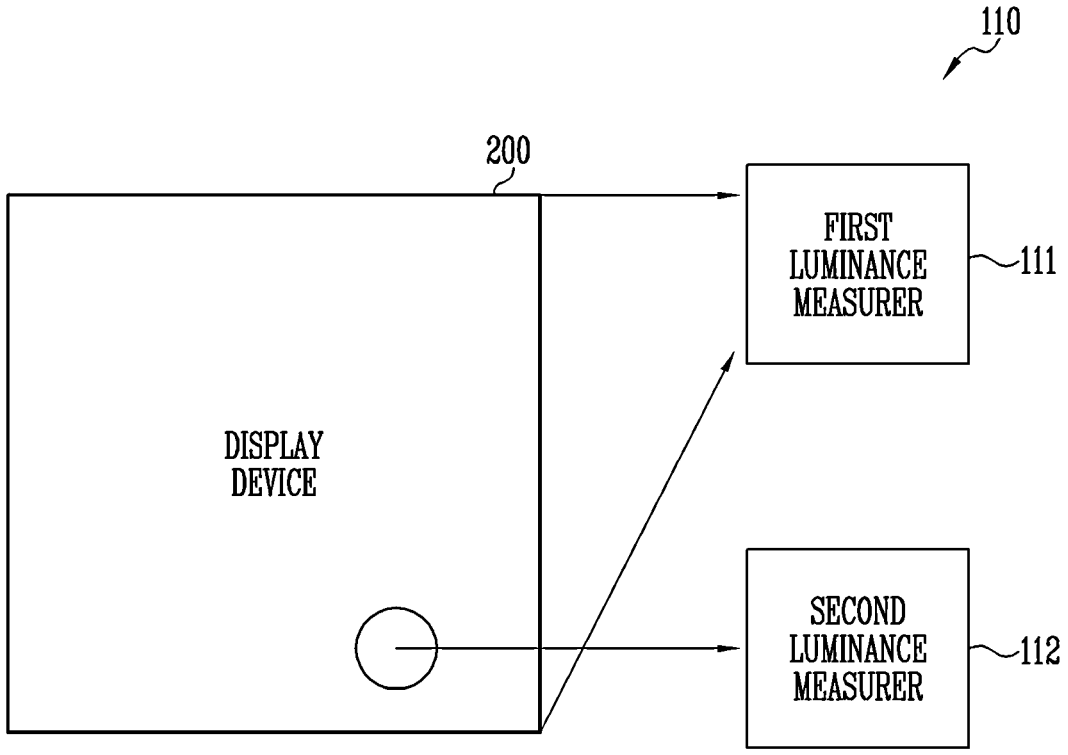
FIG. 8 illustrates an embodiment of a luminance measurer included in the optical compensation device of FIG. 1.

FIG. 8 illustrates an embodiment of a luminance measurer included in the optical compensation device of FIG. 1.

Referring to FIG. 1 and FIG. 8, the luminance measurer 110 may include a plurality of luminance measurers. In an embodiment, the luminance measurer 110 may include a first luminance measurer 111 and a second luminance measurer 112, for example.

The first luminance measurer 111 may measure luminance of an entire area of the display device 200. The second luminance measurer 112 may measure luminance of a partial area of the display device 200. In an embodiment, when a spot occurs in the partial area of the display device 200 during the gamma correction process, the second luminance measurer 112 may be additionally provided in order to improve the optical compensation performance for the corresponding partial area to measure luminance for the corresponding partial area, for example.

In this case, luminance may be more accurately measured in the partial area, based on this, a gamma value and a compensation parameter for a pixel in the partial area may be more accurately calculated, and a spot caused by a luminance deviation of the display device 200 may be removed.

In FIG. 8, it is shown that one second luminance measurer 112 is added in addition to the first luminance measurer 111, but the invention is not limited thereto. In an embodiment, when a plurality of spots spaced apart from each other occurs in the display device 200, a plurality of luminance measurers may be additionally provided to correspond to the spots, for example.

FIG. 9 illustrates a block diagram of an embodiment of a display device according to the invention.

Referring to FIG. 1 and FIG. 9, the display device 200 may include a display unit (or display panel) 210, a scan driver (or gate driver) 220, a data driver (or source driver) 230, a gamma voltage generator 240, a timing controller 250, a data compensator 260, and a storage 270.

The display unit 210 may include scan lines SL1 to SLn (where n is a positive integer) (or gate lines), data lines DL1 to DLm (where m is a positive integer), and a pixel PXL. The pixel PXL may be disposed in an area (e.g., pixel area) partitioned by the scan lines SL1 to SLn and the data lines DL1 to DLm.

The pixel PXL may be connected to at least one of the scan lines SL1 to SLn and one of the data lines DL1 to DLm. In an embodiment, the pixel PXL may be connected to a scan line SLi and a data line DLj (where, i and j are positive integers equal to or less than n and m, respectively), for example.

The pixel PXL may store or write a data voltage (or data signal) provided through the data line DLj in response to the scan signal provided through the scan line SLi, and may emit light with luminance corresponding to the data voltage.

A first power voltage VDD and a second power voltage VSS may be provided to the display unit 210. The first power voltage VDD and the second power voltage VSS are voltages desired for an operation of the pixel PXL, and the first power voltage VDD may have a voltage level higher than that of the second power voltage VSS.

The scan driver 220 may generate a scan signal based on a scan control signal SCS, and may sequentially provide the scan signal to the scan lines SL1 to SLn. Here, the scan control signal SCS may include a scan start signal, a scan clock signal, and the like, and may be provided from the timing controller 250. In an embodiment, the scan driver 220 may include a shift register (or stage) that sequentially generates and outputs a pulse type of scan signal corresponding to a pulse type of scan start signal by scan clock signals, for example.

The data driver 230 may generate data voltages based on a data control signal DCS provided from the timing controller 250, a compensated data DATA3 provided from the data compensator 260, and gamma voltages provided from the gamma voltage generator 240, and may provide the data voltages to the display unit 210 (or pixel PXL). Here, the data control signal DCS is a signal controlling an operation of the data driver 230, and may include a load signal (or data enable signal) indicating output of an effective data voltage. In an embodiment, the data driver 230 may select one of gamma voltages based on a data value (or grayscale value) included in the compensated data DATA3 to output it as a data voltage, for example.

The gamma voltage generator 240 may generate gamma voltages based on a gamma lookup table provided from the storage 270. Here, the gamma lookup table may include information (e.g., reference gamma data DATA_G) of reference gamma voltages set for reference grayscales (i.e., some grayscales selected from grayscales). In an embodiment, the gamma voltage generator 240 may include a resistance string and gamma buffers that transmit reference gamma voltages to taps (or tap points) of the resistance string. The gamma voltage generator 240 may generate gamma voltages corresponding to the entire grayscales by dividing reference gamma voltages applied to the taps by the resistance string, for example. According to the information of reference gamma voltages stored in the gamma lookup table, the gamma voltages may correspond to a predetermined gamma curve (e.g., gamma curve of 2.2).

The timing controller 250 may receive input image data DATA1 and a control signal from an external device (e.g., a graphic processor), may generate the scan control signal SCS and the data control signal DCS based on the control signal, and may convert the input image data DATA1 to generate image data DATA2. In an embodiment, the timing controller 250 may convert the input image data DATA1 of an RGB format into the image data DATA2 of an RGBG format that matches a pixel arrangement in the display unit 210, for example.

The data compensator 260 may compensate the image data DATA2 based on a compensation data DATA_C to generate a compensated data DATA3. Here, the compensation data DATA_C may be generated through the optical compensation device 100 of FIG. 1, and as described above with reference to FIG. 7, it may include a compensation parameter (or a compensation value corresponding thereto) set for each grayscale for each of the pixels PXL or at least some of the pixels PXL by grayscale. The luminance deviation of the display device 200 may be eliminated through the operation of the data compensator 260.

In an embodiment, the compensation data DATA_C may include luminance of and a gamma value of a pixel measured for a predetermined luminance level (or a predetermined reference grayscale).

In this case, the data compensator 260 may calculate a compensation parameter for each grayscale of each pixel, similar to the compensation parameter generator 321 described in FIG. 3, or may calculates a compensation value for each grayscale of each pixel, similar to the compensation data generator 322 described in FIG. 3.

In an embodiment, when the display device 200 is powered on, the data compensator 260 may load the compensation data DATA_C (e.g., the compensation data including the luminance and gamma value of the pixel measured for a predetermined reference grayscale) from the storage 270 and calculate a compensation parameter and compensation value for each grayscale of each of the pixels, for example. In this case, compared with the compensation data including the compensation parameter (or compensation value) for each grayscale of each of the pixels, the capacity of the compensation data DATA_C may be reduced, and the capacity of the storage 270 for storing this may be reduced. In addition, even when the target gamma value of the display device 200 is changed, the compensation parameter (or compensation value) corresponding to the corresponding target gamma value is derived by Equation 1 to Equation 3 described above, so that the image data DATA2 may be accurately compensated, and the luminance deviation of the display device 200 may be eliminated.

In another embodiment, the compensation data DATA_C may include a compensation parameter and a gamma value for a predetermined luminance level (or a predetermined reference grayscale).

In this case, the data compensator 260 may predict measurement luminance for a predetermined luminance level by Equation 1, and may calculate a compensation value based on a difference between the measurement luminance and the target luminance. In an embodiment, the data compensator 260 may calculate a compensation value for each grayscale of each of the pixels, similar to the compensation data generator 322, for example.

In FIG. 9, the scan driver 220, the data driver 230, the gamma voltage generator 240, the timing controller 250, and the data compensator 260 are shown to be mutually independently implemented, but are not limited thereto. In an embodiment, at least two of the data driver 230, the gamma voltage generator 240, the timing controller 250, and the data compensator 260 may be implemented with one IC (e.g., a driving IC), for example.

Figure 10:
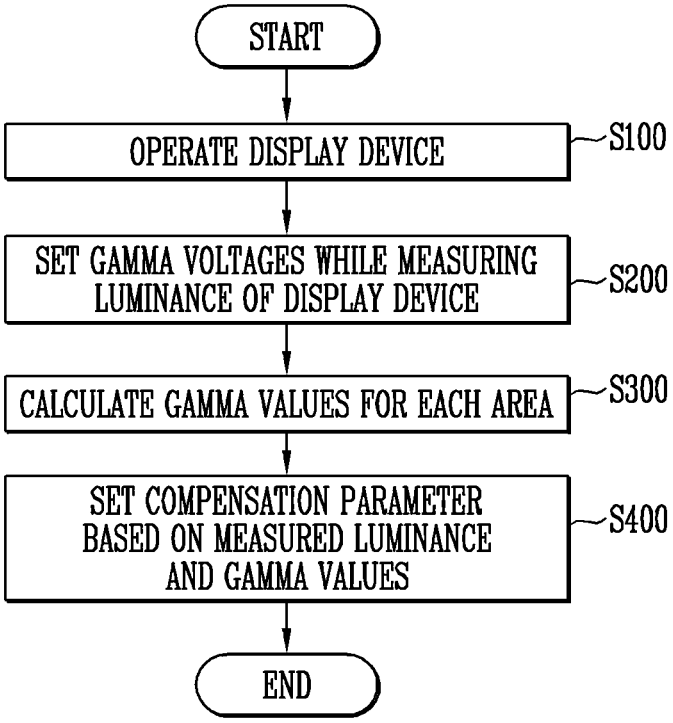
FIG. 10 illustrates a flowchart of an embodiment of an optical compensation method according to the invention.

FIG. 10 illustrates a flowchart of an embodiment of an optical compensation method according to the invention.

Referring to FIG. 1 and FIG. 10, the method of FIG. 1 may be performed by the optical compensation device 100 of FIG. 1 for the display device 200 shown in FIG. 1.

The method of FIG. 10 may operate the display device 200 (S100). In an embodiment, the method of FIG. 10 may supply the first power voltage VDD and the second power voltage VSS described above with reference to FIG. 9 to the display device 200, for example. In other words, the method of FIG. 10 may power-on the display device 200.

Then, the method of FIG. 10 may set gamma voltages while measuring luminance of the display device 200 (S200).

As described with reference to FIG. 1 and FIG. 3, the optical compensation device 100 (or compensator 120) may perform gamma correction so that the display device 200 has a gamma characteristic corresponding to a target gamma value.

Subsequently, in the method of FIG. 10, gamma values for each area of the display device 200 may be calculated based on luminances measured in the gamma correction process (S300).

As described with reference to FIG. 3 and FIG. 5, the optical compensation device 100 or compensator 120 may calculate a gamma value of a corresponding area by applying measured luminances to a predetermined equation defining a gamma curve.

Thereafter, in the method of FIG. 10, a compensation parameter may be calculated or set based on luminance (e.g., pixel luminance) measured for each of the pixels and a previously calculated gamma value (S400).

As described with reference to FIG. 3, the optical compensation device 100 (or compensator 120) may calculate a compensation parameter (or compensation value) for each grayscale of each of the pixels by Equation 1 to Equation 3.

Figure 11:
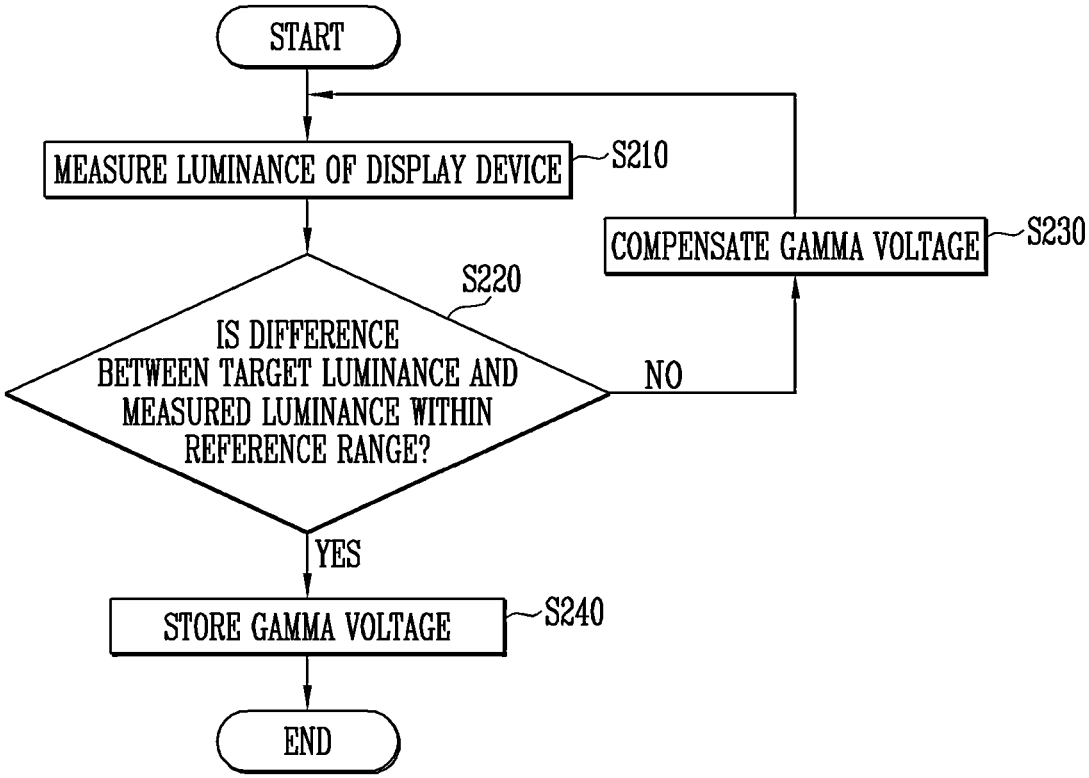
FIG. 11 illustrates a flowchart of a gamma correction operation of the method of FIG. 10.

FIG. 11 illustrates a flowchart of a gamma correction operation of the method of FIG. 10.

Referring to FIG. 10 and FIG. 11, the method of FIG. 10 may provide a data voltage (or gamma voltage) corresponding to a predetermined reference grayscale (or a predetermined luminance level) to the display device 200, and may measure luminance of the display device 200 displaying an image based on the data voltage (S210).

The method of FIG. 11 may determine whether a difference (or luminance difference) between the measured luminance and the target luminance (or luminance level) is within the reference range (S220), and when the difference between the measured luminance and the target luminance is out of the reference range, it may compensate or adjust the voltage level of the data voltage (or gamma voltage) (S230). Thereafter, based on the compensated (or adjusted) data voltage, the luminance of the display device 200 displaying the image may be re-measured, and it may be determined again whether a difference between the re-measured luminance and the target luminance is within the reference range.

The method of FIG. 11 may repeatedly adjust the voltage level of the data voltage (or gamma voltage) until the difference between the measured luminance and the target luminance becomes within a reference range.

When the difference between the measured luminance and the target luminance is within the reference range, the compensator 120 may determine or store a voltage level of the finally adjusted data voltage as a gamma voltage (or gamma voltage voltage) (S240).

Figure 12:
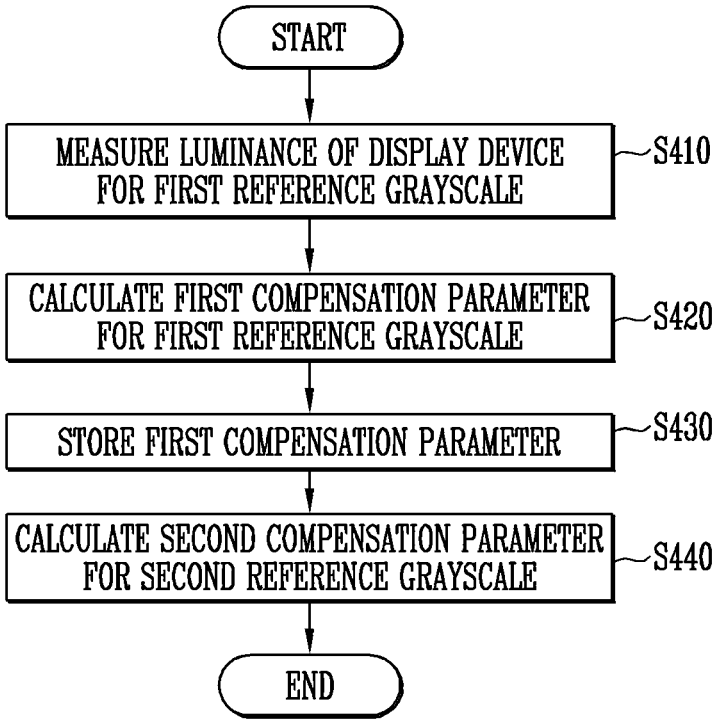
FIG. 12 illustrates a flowchart of an operation of setting a compensation parameter of the method of FIG. 10.

FIG. 12 illustrates a flowchart of an operation of setting a compensation parameter of the method of FIG. 10.

Referring to FIG. 10 and FIG. 12, the method of FIG. 12 may measure the luminance of the display device 200 with respect to the first reference grayscale (S410). In an embodiment, the method of FIG. 12 may provide a data voltage corresponding to a grayscale of 255 to the display device 200, and measure luminance of the display device 200 displaying an image based on the data voltage, for example. In an embodiment, the method of FIG. 12 may measure luminance (i.e., pixel luminance) of each of the pixels in the display device 200, for example.

Then, the method of FIG. 12 may calculate a first compensation parameter for the first reference grayscale based on the target luminance for the first reference grayscale and the measured luminance (S420). The method of FIG. 12 may calculate the first compensation parameter for the first reference grayscale by Equation 1, as described with reference to FIG. 3.

Thereafter, the method of FIG. 12 may store the first compensation parameter (S430). Referring to FIG. 7, for example, the method of FIG. 12 may generate the first compensation data DATA_C_RG1 including the first compensation parameter calculated for each of the pixels, and may store the first compensation data DATA_C_RG1 in the storage 330 (refer to FIG. 3).

Then, the method of FIG. 12 may calculate the second compensation parameter for the second reference grayscale (i.e., the remaining reference grayscales excluding the first reference grayscale) based on the luminance and gamma value previously measured for the first reference grayscale (S440). As described with reference to FIG. 3, the method of FIG. 12 may use Equation 2 to respectively calculate the target luminance for the second reference grayscale and the predicted luminance for the pixel, and may apply the target luminance and the predicted luminance to Equation 3 to calculate the second compensation parameter for the reference grayscale. As described with reference to FIG. 7, the method of FIG. 12 may generate the second compensation data including the second compensation parameter calculated for each of the pixels.

In an embodiment, the method of FIG. 12 may calculate a compensation value based on a corresponding grayscale and compensation parameter, and may generate compensation data including the compensation value.

As described above, the optical compensation method may calculate the gamma value for each area of the display device 200 based on the luminances measured in the gamma correction process, may measure only the luminance for one reference grayscale in the optical compensation process, may predict the luminance for another reference grayscale based on the measured luminance and the preset gamma value for each area, and may set the compensation parameter (or compensation value) for another reference grayscale based on the predicted luminance. In the optical compensation process, since luminance is measured for only one reference grayscale, not a plurality of reference grayscales, an optical compensation time (i.e., tact time) may be reduced. In addition, since the gamma value for each area is calculated based on the luminances measured for a plurality of grayscales in the gamma correction process, luminance for another reference grayscale may be accurately predicted based on the gamma value, and a compensation parameter for another reference grayscale may be accurately calculated.

While the invention has been shown and described with reference to predetermined embodiments thereof, it will be understood by those skilled in the art that various changes in forms and details may be made therein without departing from the spirit and scope of the invention.

What is claimed is:

1. An optical compensation device for a display device including a plurality of areas, the optical compensation device comprising:

a luminance measurer which measures a display luminance of the display device;

a gamma corrector which corrects a gamma voltage so that a first area of the plurality of areas has a gamma characteristic corresponding to a target gamma value based on the display luminance, and calculates a gamma value for each of the plurality of areas based on the display luminance; and an optical compensator which calculates a compensation parameter for each of grayscales based on the display luminance and the gamma value, wherein a luminance deviation for each of the plurality of areas of the display device is compensated based on the compensation parameter, and wherein after the gamma voltage is corrected by the gamma corrector, in a process of generating the compensation parameter, the luminance measurer measures the display luminance for only one reference grayscale.

2. The optical compensation device of claim 1, wherein the gamma corrector calculates the gamma value based on display luminances measured corresponding to a plurality of reference grayscales in a process of correcting the gamma voltage.

3. The optical compensation device of claim 2, wherein at least two areas of the plurality of areas have different gamma values from each other.

4. The optical compensation device of claim 2, wherein the display device further includes a pixel, and wherein a first compensation parameter for a first grayscale of the grayscales is defined as a ratio of a first target luminance to a first display luminance of the pixel corresponding to the first grayscale.

5. The optical compensation device of claim 4, wherein the optical compensator calculates a second target luminance of the pixel for a second grayscale of the grayscales based on the first target luminance and the target gamma value, predicts a second display luminance of the pixel corresponding to the second grayscale based on the first display luminance and the gamma value, and calculates a second compensation parameter for the second grayscale based on the second target luminance and the second display luminance.

6. The optical compensation device of claim 5, wherein the optical compensator calculates the compensation parameter based on an equation below, $$C_i = \frac{L_{Ti}}{L_{Pi}} = \frac{L_{T1} \cdot (Gi/G1)^{\gamma T}}{L_{P1} \cdot (Gi/G1)^{\gamma P}} \quad \text{[Equation]}$$

wherein Ci denotes a compensation parameter for an i-th grayscale of the grayscales where i is a positive integer, $L_{Ti}$ denotes a target luminance for an i-th reference grayscale of the plurality of reference grayscales, $L_{T1}$ denotes a target luminance for a first reference grayscale of the plurality of reference grayscales, Gi denotes a value of the i-th reference grayscale, G1 denotes a value of the first reference grayscale, $\gamma_T$ denotes a target gamma value, $L_{Pi}$ denotes a predicted luminance of a corresponding pixel for the i-th reference grayscale, $L_{P1}$ denotes a measured luminance of the corresponding pixel for the first reference grayscale, and $\gamma_P$ denotes a gamma value of an area of the plurality of areas including the corresponding pixel.

7. The optical compensation device of claim 5, wherein the optical compensator generates first compensation data including the first compensation parameter and second compensation data including the second compensation parameter, respectively.

8. The optical compensation device of claim 5, wherein the optical compensator calculates a compensation value for the first grayscale based on the first display luminance and the first compensation parameter, and wherein the compensation value corresponds to a grayscale of the grayscales which causes the pixel to emit light with the first target luminance.

9. A display device comprising:

a display panel including pixels;

a storage which stores compensation data including a compensation parameter set for at least a pixel of the pixels;

a data compensator which generates compensated data by compensating image data based on the compensation data; and a data driver which generates data voltages based on the compensated data and provides the data voltages to the pixels, wherein the data compensator calculates a display luminance for each of grayscales of the pixels based on the compensation parameter, calculates a compensation value based on a difference between the display luminance and a target luminance for each of the grayscales, and compensates a data value included in the image data based on the compensation value, and wherein the compensation parameter for a first grayscale of the grayscales is defined as a ratio of the target luminance to the display luminance of the pixels corresponding to the first grayscale.

10. The display device of claim 9, wherein the compensation data further includes a gamma value for the at least the pixel of the pixels.

11. An optical compensation method for a display device including a plurality of areas, the method comprising:

while measuring display luminance of the display device, correcting a gamma voltage based on the display luminance so that a first area of the plurality of areas has a gamma characteristic corresponding to a target gamma value;

calculating a gamma value for each of the plurality of areas based on the display luminance; and calculating a compensation parameter for each of grayscales based on the display luminance and the gamma value, wherein the calculating the compensation parameter includes measuring only the first display luminance of the display device for the first grayscale once.

12. The optical compensation method of claim 11, wherein a luminance deviation for each of the plurality of areas of the display device is compensated based on the compensation parameter.

13. The optical compensation method of claim 11, wherein the correcting the gamma voltage includes:

providing a first data voltage corresponding to a first reference grayscale to the display device, and measuring the first display luminance of the display device displaying an image corresponding to the first data voltage;

determining whether a difference between a first target luminance for the first reference grayscale and the first display luminance is within a reference range; and determining the first data voltage as an updated gamma voltage when the difference between the first target luminance and the first display luminance is within a reference range.

14. The optical compensation method of claim 11, wherein the calculating the compensation parameter includes:

measuring the first display luminance of the display device for the first grayscale of the grayscales;

calculating a first compensation parameter for the first grayscale based on the first display luminance; and calculating a second compensation parameter for a second grayscale of the grayscales different from the first grayscale based on the first display luminance and the gamma value.

15. The optical compensation method of claim 14, wherein the first compensation parameter is defined as a ratio of a first target luminance for the first grayscale to the first display luminance.

16. The optical compensation method of claim 15, wherein the calculating the second compensation parameter includes:

calculating a second target luminance of a pixel for the second grayscale based on the first target luminance and the target gamma value;

predicting a second display luminance of the pixel corresponding to the second grayscale based on the first display luminance and the gamma value; and calculating the second compensation parameter based on the second target luminance and the second display luminance.

17. The optical compensation method of claim 16, wherein in the calculating the second compensation parameter, the compensation parameter is calculated based on a following equation, $$C_i = \frac{L_{Ti}}{L_{Pi}} = \frac{L_{T1} \cdot (Gi/G1)^{\gamma T}}{L_{P1} \cdot (Gi/G1)^{\gamma P}} \quad \text{[Equation]}$$

wherein Ci denotes a compensation parameter for an i-th grayscale of the grayscales where i is a positive integer, $L_{Ti}$ denotes a target luminance for an i-th reference grayscale, $L_{T1}$ denotes a target luminance for a first reference grayscale, Gi denotes a value of the i-th reference grayscale, G1 denotes a value of the first reference grayscale, γT denotes a target gamma value, $L_{Pi}$ denotes a predicted luminance of a corresponding pixel for the i-th reference grayscale, $L_{P1}$ denotes a measured luminance of the corresponding pixel for the first reference grayscale, and γP denotes a gamma value of an area of the plurality of areas including a corresponding pixel.

18. The optical compensation method of claim 16, wherein the calculating the first compensation parameter includes calculating a compensation value for the first grayscale based on the first display luminance and the first compensation parameter, and wherein the compensation value corresponds to a grayscale of the grayscales which causes the pixel to emit light with the first target luminance.

* * * * *